United States Patent [19]

Talpo

[11] Patent Number: 4,604,508

[45] Date of Patent: Aug. 5, 1986

[54] ELECTRIC CIRCUIT BREAKER OF THE TYPE USING AN ARC QUENCHING FLUID WITH PRESSURE SELF-GENERATING DUE TO THE BREAKDOWN OF THE FLUID

[75] Inventor: Gianpietro Talpo, Bergamo, Italy

[73] Assignee: SACE S.p.A. Costruzioni Elettromeccaniche, Bergamo, Italy

[21] Appl. No.: 691,014

[22] Filed: Jan. 14, 1985

[30] Foreign Application Priority Data

Jan. 20, 1984 [IT] Italy ..... 20599/84[U]

[51] Int. Cl.[4] ..... H01H 33/74

[52] U.S. Cl. ..... 200/148 R; 200/150 D; 200/150 B

[58] Field of Search ..... 200/148 R, 150 D, 150 B

[56] References Cited

U.S. PATENT DOCUMENTS

| | | | |
|---|---|---|---|
| 4,253,002 | 2/1981 | Kii | 200/148 R |
| 4,259,555 | 3/1981 | Kii | 200/150 D |
| 4,270,034 | 5/1981 | Kii | 200/150 D |

FOREIGN PATENT DOCUMENTS

| | | | |
|---|---|---|---|
| 695436 | 8/1940 | Fed. Rep. of Germany | 200/150 D |
| 1286509 | 1/1962 | France | 200/150 B |

*Primary Examiner*—Robert S. Macon

*Attorney, Agent, or Firm*—Diller, Ramik & Wight

[57] ABSTRACT

In an electric circuit breaker of the type using an arc quenching fluid with pressure self-generating by the breakdown of the fluid due to the same arc, comprising, inside a tightly sealed insulating casing filled with the extinguishing fluid, in particular with such a gas as sulphur hexafluoride, two plate-shaped current bearing connections, of which one supports a stationary main contact and a tubular stationary arc contact, and the other is provided with a guide for a stem supporting a movable main contact and a rod-shaped movable arc contact, a drive mechanism for moving said stem from a closure position to an opening position of the contacts and vice-versa, a first extinguishing fluid collecting and compression chamber surrounding the stationary arc contact and having an outlet opening suitable to be closed by said movable arc contact, at least a further collecting and compressing chamber having an outlet opening, as well as means for closing said outlet opening of said further chamber, the outlet openings of said first chamber and of the further chamber are coaxial and aligned with the axis of the rod-shaped movable arc contact movement, and this movable arc contact is the means for closing the outlet opening of the further chamber, the outlet opening of the first chamber leading to the further chamber.

8 Claims, 4 Drawing Figures

Figure 1:
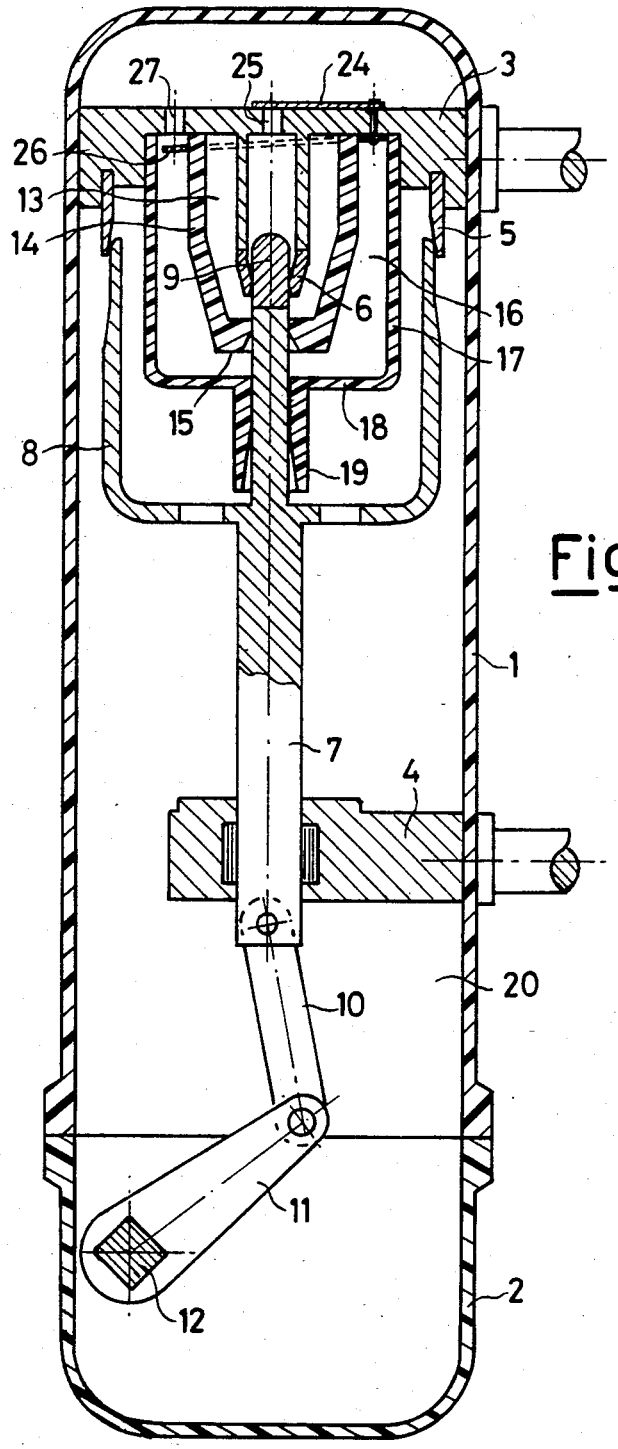

ELECTRIC CIRCUIT BREAKER OF THE TYPE USING AN ARC QUENCHING FLUID WITH PRESSURE SELF-GENERATING DUE TO THE BREAKDOWN OF THE FLUID

The object of the present invention is a circuit breaker of the type using an arc quenching fluid, with pressure self-generation by the decomposition of the fluid.

Circuit breakers of this type are known e.g. from the German Patent Application DE-OS No. 33 00 816.

These circuit breakers adopt a system of circuit breaking and of quenching or extinguishing of the arc, created during the opening movement of a suitable movable arc contact relatively to a stationary arc contact, using an extinguishing medium, generally a gas such as sulphur hexafluoride, which system exploits the principle of the generating, inside at least one fluid collecting chamber, of a pressure due to the decomposition and heating of the fluid by the energy of the arc, in order to realize a flow or blast of fluid, such as to cause, at the passage of the electric current through the zero value, the extinguishment of the arc and hence the interruption of the electric current.

According to a known solution for such a type of electric circuit breaker, a single fixed-volume fluid collecting chamber is provided, which concentrically surrounds the stationary arc contact, and which ends into a nozzle of insulating material suitable to be closed by the movable arc contact, having a stem shape. As a succession with said nozzle a suction chamber is formed bounded by a movable main contact having the shape of a cylindrical wall solid, through an end wall, with the movable stem-shaped arc contact, by a stationary insulating cylindrical wall and by the said nozzle. The movable assembly formed by the movable main contact and by the movable arc contact is suitable to be axially shifted by means of a driving mechanism, and an outer shell encases in a fluid-tight fashion the whole pole and is filled with the quenching fluid. In stage of opening of the circuit breaker under the action of the driving mechanism, the movable main contact is first separated from the related stationary main contact, so that all the electric current flows through the stationary and movable arc contacts. The movable arc contact is then spaced apart from the stationary arc contact, the outlet nozzle of the fluid collecting chamber being kept still closed, and an arc arises therefore between said arc contacts. The energy of this arc causes the breakdown and the heating of the fluid, which flows back into the collecting chamber, where it is mixed with fresh fluid, generating a pressure surge in the same collecting chamber, while the pressure is decreased in the suction chamber due to the increase of its volume. At the moment at which the movable arc contact disengages the outlet nozzle of the collecting chamber, the same is placed in communication with the suction chamber via the nozzle, the quenching fluid escapes under pressure in the form of a blast from the first of said chambers into the second one, and thus causes the extinguishment of the arc. In the meanwhile, a part of fluid is expelled from the collecting chamber through an opening in correspondence of the stationary arc contact into the outer space enclosed by said shell. At the end of the opening movement of the movable assembly also the suction chamber is opened towards said outer space through a passage created by the separation of the cylindrical wall of the movable main contact from the stationary insulating cylindrical wall. If through the circuit breaker electric currents flow which are not high enough for generating, inside the constant volume collecting chamber, through the arc energy, such a pressure of the quenching fluid, as to cause the extinguishing of the arc by means of the blast described above, this known solution exploits also the suction effect of said suction chamber, in order to anyway cause the desired extinguishment of the arc, by sucking in some fluid from the outer space through said opening in correspondence of the stationary arc contact inside the collecting chamber and from this inside the suction chamber through the nozzle, so that the flow of sucked fluid, by crossing the arc in the passage bore of the nozzle, causes the extinguishment of the same arc. However, in such a case, in addition to a good tightness of the suction chamber, also a high movable assembly actuating force is required from the driving device.

To the purpose of eliminating these drawbacks, in the German Patent Application aforementioned another solution is proposed which, instead of a single quenching fluid collecting chamber having a constant volume, provides a plurality of partial collecting chambers, suitable to be activated in succession by means of valve means sensitive to the pressure of the fluid, which is generated by the breakdown and heating due to the arc energy in the first partial chamber. According to these solution using a variable volume collecting chamber, the first partial chamber is always active, and the arc generates therein a pressure which is a function of the arc energy, and hence of the intensity of the electric current to be interrupted. If the value of this current is relatively low, and therefore also the thermal energy of the arc is low, the pressure of extinguishing fluid generated inside the first partial chamber is sufficient for the quenching of the arc. If on the contrary the value of the electric current increases, also the generated pressure increases consequently, but the quantity of the extinguishing fluid contained in the first partial chamber is not large enough for obtaining the extinguishing of the arc. This increased pressure causes therefore the displacement of the valve means against the action of elastic means, so that the second partial chamber is activated, which is placed in communication with the first chamber, thus increasing the overall volume of the extinguishing fluid available under high pressure and at a temperature low enough for a satisfactory arc quenching capacity. In the same way, with still higher current values, further partial collecting chambers can be activated.

This solution allows the self-extinguishing of the arc to be obtained within a wide range of current values to be interrupted, but it suffers from several remarkable structural and functional disadvantages. The reliability of the quenching system is based on the correct calibration of the valves with their related springs, and on their proper operation in the long run, which can be prevented by arc generated dusts, containing metal particles coming from the arc contacts, which can deposit on the valve seats, damaging them. The system requires external mechanical and electrical devices for controlling the intervention of the several partial collecting chambers during the opening manoeuvre which not only render complicate the same system, but which render the solution also cumbersome and expensive, being it needed the length of the pole to be increased. The difficulty moreover exists of coordinating the return time to the initial condition after a circuit breaking, with the restoration time of the external mechanical system, keeping in mind that according to present regulations the time between two opening manoeuvres may be of 0.3 seconds.

Purpose of the present invention is therefore to provide an electric circuit breaker of the type using an arc extinguishing fluid with pressure self-generating by the breakdown of the fluid caused by the arc, which, with a simple and reliable structure of reduced size, in particular in the longitudinal sense of the pole, allows optimum circuit breakings to be achieved for all the values of current to be interrupted, which have to be faced by the circuit breaker.

In order to achieve such a purpose, the present invention provides an electric circuit breaker comprising, inside a tightly sealed insulating casing, filled with an arc quenching fluid, in particular with a gas such as sulphur hexafluoride, two plate shaped current bearing connections, of which, one supporting a stationary main contact and a tubular stationary arc contact, and the other provided with a guide for a stem supporting a movable main contact and a rod-shaped movable arc contact, a driving mechanism for moving said stem from a contact closure position to a contact opening position and vice-versa, a first chamber of collecting and compression of the extinguishing fluid surrounding the stationary arc contact and provided with an outlet opening suitable to be closed by said movable arc contact, at least a further collecting and compression chamber provided with an outlet opening, as well as means for closing said outlet opening of said further chamber, said circuit breaker being characterized in that the outlet openings of the first chamber and of the further chamber are coaxial and in line with the axis of movement of the rod-shaped movable arc contact, and that this movable arc contact is the means for the closing of the outlet opening of the further chamber, the outlet opening of the first chamber leading to the further chamber.

According to the invention is therefore foreseen that the same rod-shaped movable arc contact during its movement from the closure position to the opening position, after its separation from the tubular stationary arc contact, opens first the outlet opening of the first chamber placing it in communication with the further chamber, and increasing thus the volume thereof, and then the outlet opening of the further chamber placing the inside of the two chambers in communication with the outer space enclosed by the tightly sealed casing.

If more than one further chambers are foreseen, their outlet openings are opened in succession during the movement of the rod-shaped movable arc contact, and each of them leads to the following one, with the outlet opening of the last one of said further chambers leading to the outer space enclosed by the casing.

The several collecting and compression chambers of the circuit breaker according to the invention may be positioned concentrically to each other, but a positioning thereof is also possible in succession in the axial direction.

The volumes of the chambers are proportioned to the arc energy involved by the current to be interrupted, and the number of the chambers, as well as the size of their outlet openings, which may have the shape of nozzles made of insulating material, may vary in function of the circuit breaking performances which the circuit breaker must ensure.

Figure 2:
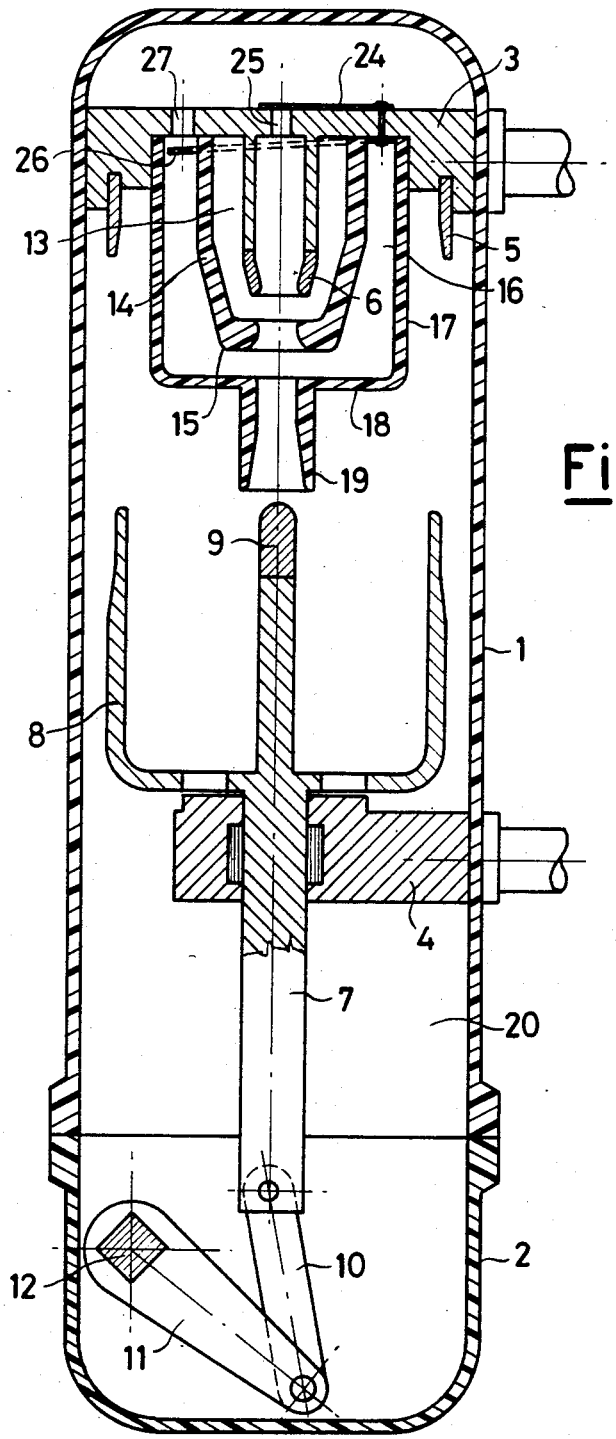
Figure 3:
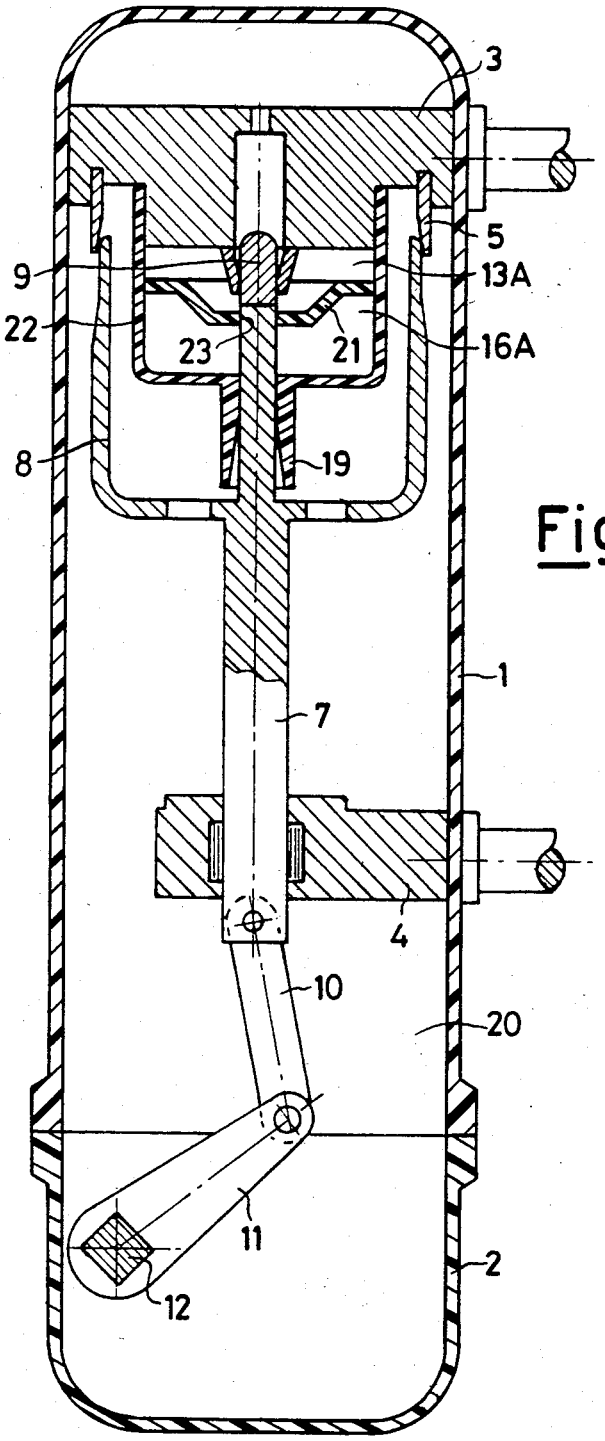
Figure 4:
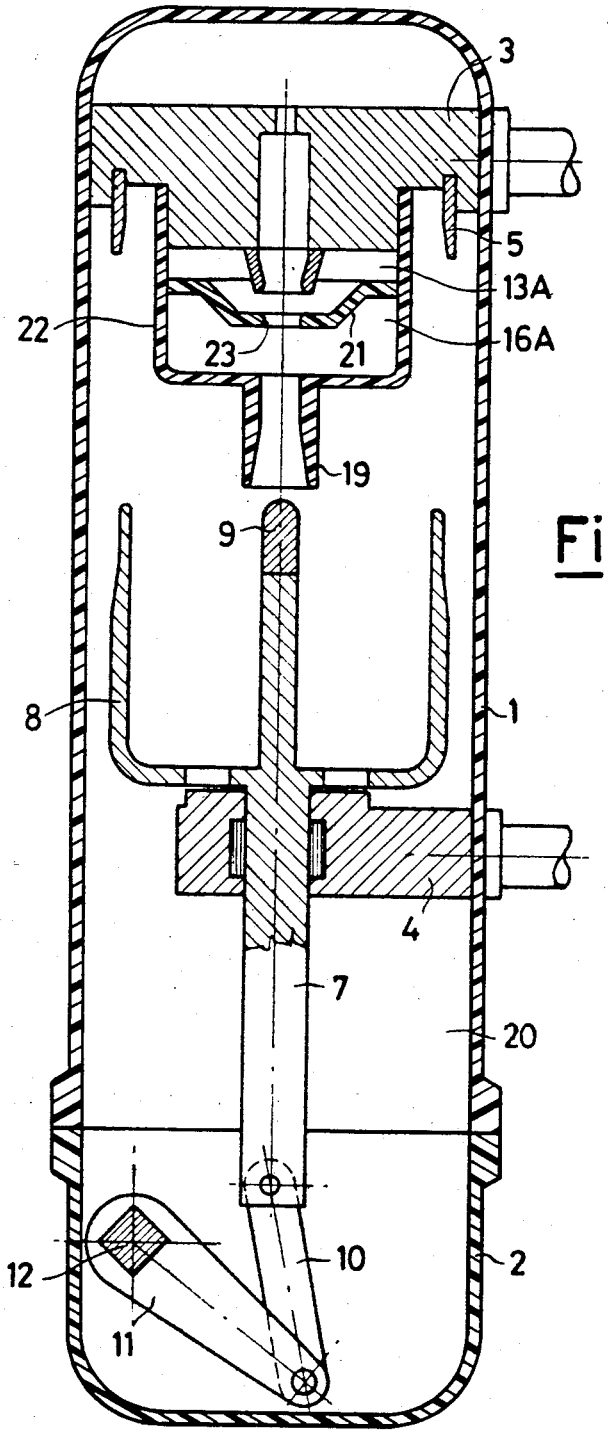

The characteristics and advantages of the circuit breaker according to the invention will result more clearly from the following description of two exemplifying embodiments with reference to the drawings, in which FIGS. 1 and 2 show in axial section a first embodiment of the circuit braker respectively in its closing position and in its opening position, and FIGS. 3 and 4 show in a similar way a different embodiment.

The two exemplifying embodiments shown are substantially different only because of the different positioning of the collecting and compression chambers of the extinguishing fluid viz. gas. The description of the example shown is therefore valid also for the variant thereof, and similar components are indicated with the same reference numbers.

In the drawings a single pole is shown of an electric circuit breaker, which may be either unipolar, or multipolar. In this latter case, it is intended that each pole of the circuit breaker has the same shape as the one shown an described hereunder.

The pole of the circuit breaker comprises an insulating casing 1 tightly sealed downward by a box 2. The casing 1 contains the extinguishing fluid, such as sulphur hexafluoride, and is provided with current bearing connections 3 and 4. The upper connection 3 supports a stationary main contact 5, e.g. of the finger type, and centrally a tubular stationary arc contact 6. The stationary main contact 5 is proportioned on the basis of the rated electric current of the pole. In the second lower connection 4 a stem 7 is supported and guided by means of a sliding blade system, such stem bearing in its upper part a movable main contact 8 suitable to cooperate with the stationary main contact 5, as well as a movable rod-shaped arc contact 9 suitable to cooperate with the tubular stationary arc contact 6. The movable arc contact 9 is provided with an arc-resistant coating.

The stem 7 is linked in its lower part, through an insulating tie-rod 10 and a metal lever 11, with a shaft 12 of a drive mechanism, said shaft extending out of the casing 1 in a gas-tight fashion.

The stationary main contact 5 delimits the volume within which the quenching gas collection and compression chambers are provided, and within which the tubular stationary arc contact 6 is placed.

In particular, in the embodiment shown in FIGS. 1–2, a first chamber 13 surrounds concentrically the stationary arc contact 6 and is bounded upward by the upper connecting current bearing plate 3, to which a circumferential wall of insulating material 14 is fastened of partly cylindrical and partly conical shape, which ends in its lower part in a nozzle 15. Concentrically surrounding said first chamber 13 a second chamber 16 is provided, bounded upward always by the connection plate 3, and circumferentially by a cylindrical wall of insulating material 17 with a bottom 18 is which a nozzle shaped opening 19 is provided. It must be noted that the opening of the nozzle 15 of the first chamber 13 leads to the second chamber 16, whilst the opening of the nozzle 19 of the second chamber 16 leads to the outer space 20 enclosed by the casing 1. Moreover, the outlet openings of the two nozzles 15 and 19 are coaxial, and lined up with the centre axis of the pole, which coincides with the axis of the tubular stationary arc contact 6 and with the axis of the movement of the rod-shaped movable arc contact 9. This latter therefore can close the openings of both the nozzles 15 and 19, as it can be seen from FIG. 1.

In the variant shown in FIGS. 3–4, also two collecting and compression chambers 13A and 16A are provided, but these chamber, instead of being concentrical, are placed one in succession to the other. In particular, the first chamber 13A surrounds the stationary arc contact 6 and is provided above the second chamber 16A, from which it is divided by a transversal wall 21, inside a hollow cylindrical body 22 made of insulating material, fastened to the upper current bearing connecting plate 3 and ending downward in the nozzle 19. The transversal wall 21 has a central opening 23 coaxial with the opening of the nozzle 19, and can be closed, as this latter, by means of the rod-shaped movable arc contact 9.

As shown in FIGS. 1–2, the stationary arc contact 6 may be provided with a discharge valve having the shape of an elastic blade 24 preloaded to maintain normally closed a discharge bore 25 leading to the outer space 20 enclosed by the casing 1. This discharge valve can intervene when the pressure in the extinguishing gas collecting chamber exceeds a predetermined value to the purpose of maintaining the overpressure inside the chambers within fixed values.

Moreover, a further valve can be provided (preloaded elastic blade 26 which normally leaves open a bore 27 in the connecting plate 3) whose purpose is of allowing a quick recovery of the extinguishing gas in the collecting chamber at circuit breaking ended.

The operating way of the circuit breaker described is as follows.

It is to be noted that the positioning of the switching parts inside the insulating casing 1 effects a subdivision into different zones, which have different functions according to the value of the current the circuit breaker is requested to switch off.

For low value currents, the switching off is carried out by the simple separation of the movable arc contact 9 from the stationary one 6, after that the stationary and the movable main contacts have reached a long enough insulating distance. For medium currents the first collecting chamber 13 or 13A surrounding the stationary arc contact intervenes, and the second chamber 16 or 16A acts as the compressed gas discharge and collecting chamber, due to the arc energy coming from the first chamber 13 or 13A. For high currents, both the first chamber 13 or 13A and the second chamber 16 or 16A intervene as collecting chambers, and the overall volume enclosed by the casing 1 acts as the collecting and discharge zone of the decomposed gas coming from the two chambers.

The volumes of the chambers 13 or 13A and 16 or 16A are proportioned to the energy of the arc called into play by the different values of current to be interrupted.

The opening movement is driven by the driving mechanism through the shaft 12, the lever 11 and the connecting rod 10. During this opening movement from the position shown in FIG. 1 and respectively in FIG. 3 towards the open position shown in FIG. 2 and respectively in FIG. 4, the main contacts 5–8 open first, and then the arc contacts 6–9 open, the arc arising between these two latter. In function of the arc energy wasted, a certain amount of extinguishing gas is broken down which collects, for the first part of the stroke of the movable arc contact, within the first collecting chamber 13 or 13A increasing the pressure therein. When the movable arc contact 9 in its movement liberates the nozzle of insulating material 15 or the outlet opening 23 of the first chamber 13 or 13A (which nozzle or opening is shaped and proportioned, as well as the volume of the first chamber, for interrupting small and medium currents), the quenching gas compressed by the dissociation and heating action due to the arc energy, and stored in the same chamber, expands into the second chamber 16 or 16A and causes the extinguishment of the arc.

For large current values, the first chamber 13 or 13A is insufficient to the purpose of effecting the extinguishing of the arc and the circuit breaking and thus, with a further movement of the movable arc contact, the second chamber 16 or 16A becomes the collecting chamber of the gas compressed by the dissociation and the heating action determined by the energy of the arc. When the movable arc contact 9 opens the opening of the nozzle 19 of the second chamber, the blast of escaping gas causes the extinguishing of the arc and the switching off.

As it results from the preceding disclosure, the circuit breaker according to the invention with a plurality of quenching fluid collecting and compression chambers is lacking of distinct valve means with related springs and of mechanical and/or electrical devices of insertion or actuating of the chambers, the function of such means and devices being assigned to the rod-shaped movable arc contact itself. It results therefrom a structure simple and of reduced overall size with greater reliability and operating safety relatively to solutions known, with the possibility of achieving optimum circuit breakings for all current values to be interrupted, already starting from the lower ones, relatively to which the first one of the extinguishing fluid collecting and compressing chambers is dimensioned.

The position of the nozzles of the several chambers may be correlated with the opening speed of the assembly of movable contacts, so as to make it possible to carry out the circuit breaking with predetermined arc times and strokes of the movable contact assembly.

The first collecting chamber (the inner one, in the embodiment with concentric positioning of the chambers) is proportioned for the interrupting of low and medium currents and the further chamber (the outer one in the case of the concentric positioning) is used as the volume for the expansion of the gas compressed in the first chamber during the arc time. The further chamber (the outer one) is proportioned for the interrupting of strong currents and is provided with a nozzle which, in function of the opening stroke of the movable arc contact, proportions the discharge of the gas to the outer volume enclosed by the casing.

By conferring a small suitable ovality or by properly shaping the opening of the discharge nozzles the possibility exists of optimizing the relative value of the pressure between two consecutive chambers, so as to partly anticipate the transmission of the pressure surge to the subsequent chamber, without waiting for the movable arc contact to completely liberate the inserting port of the interested chamber.

The manoeuvering power required from the driving unit is independent of the value of the current to be interrupted and is very small, as the circuit breaking is exclusively committed to the breakdown of the gas, and is proportioned to the same energy of the arc.

I claim:

1. Electric circuit breaker of the type using an arc extinguishing fluid with pressure self-generating by the breakdown of the fluid due to the same arc, comprising, inside a tightly sealed insulating casing filled with the extinguishing fluid, in particular with a gas such as sulphur hexafluoride, two plate-shaped current bearing connections, of which one supporting a stationary main contact and a tubular stationary arc contact, and the other being provided with a guide for a stem supporting a movable main contact and a rod-shaped movable arc contact, a drive mechanism for moving said stem from a closure position to an opening position of the contacts and vice-versa, a first extinguishing fluid collecting and compression chamber surrounding the tubular stationary arc contact and provided with an outlet opening adapted to be closed by said movable arc contact, at least a further collecting and compression chamber outboard of said first chamber provided with an outlet opening, characterized in that the stationary main contact and the movable main contact are outboard of said further chamber, the outlet openings of the first chamber and of the further chamber are coaxial and alined with the axis of the rod-shaped movable arc contact, and the movable arc contact defines means for closing the outlet opening of the further chamber, and the outlet opening of the first chamber is in fluid communication with the outlet opening of the further chamber.

2. Circuit breaker as claimed in claim 1, characterized in that the said first chamber and the said further chambers are positioned concentrically around the tubular stationary arc contact.

3. Circuit breaker as claimed in claim 1, characterized in that the further chambers are placed axially in succession relatively to the first chamber, and are divided from each other and from the first chamber by means of transversal walls.

4. Circuit breaker as claimed in claim 1, characterized in that the movable arc contact is of circular cross section, and that the outlet openings of the chambers are of shapes and sizes near to the cross section of the movable arc contact.

5. Circuit breaker as claimed in claim 4, characterized in that the outlet openings of the chambers are longitudinal ovally shaped.

6. Circuit breaker as claimed in claim 1, characterized in that the chamber are provided with valves for the adjustment of the pressure generated therein, and for the fast recovery of the extinguishing fluid from the chambers at circuit breaking carried out.

7. Circuit breaker as defined in claim 1, characterized in that said casing defines another chamber outboard of said further chamber, said further chamber being defined by relatively spaced inner and outer peripheral walls, and opening means in said outer peripheral wall defining said further chamber outlet opening for placing said further chamber in fluid communication with said another chamber.

8. Circuit breaker as defined in claim 7 characterized in that said rod-shaped movable contact is solid.

* * * * *